US005778555A

United States Patent [19]

Lehtinen et al.

[11] Patent Number: 5,778,555

[45] Date of Patent: Jul. 14, 1998

[54] APPARATUS FOR DRYING AND SMOOTHING A FIBRE WEB

[75] Inventors: Jukka Lehtinen; Taisto Juntunen; Paavo Rautakorpi, all of Tampere, Finland

[73] Assignee: Valmet Corporation, Helsinki, Finland

[21] Appl. No.: 809,983

[22] PCT Filed: Oct. 10, 1995

[86] PCT No.: PCT/FI95/00559

§ 371 Date: Jul. 15, 1997

§ 102(e) Date: Jul. 15, 1997

[87] PCT Pub. No.: WO96/11300

PCT Pub. Date: Apr. 18, 1996

[30] Foreign Application Priority Data

Oct. 11, 1994 [FI] Finland ..... 944775

[51] Int. Cl.[6] ..... F26B 13/26

[52] U.S. Cl. ..... 34/71; 34/95; 34/116

[58] Field of Search ..... 34/71, 95, 116, 34/117, 119, 124; 100/93 P, 93 RP; 162/206, 207, 358.3, 358.5

[56] References Cited

U.S. PATENT DOCUMENTS

| | | | |
|---|---|---|---|
| 4,461,095 | 7/1984 | Lehtinen | 34/41 |
| 4,719,707 | 1/1988 | Klapp | 34/94 |
| 4,958,444 | 9/1990 | Rautakorpi et al. | 34/71 |
| 5,071,513 | 12/1991 | Bluhm et al. | 162/206 |
| 5,553,392 | 9/1996 | Hanaya | 34/115 |
| 5,594,997 | 1/1997 | Lehtinen | 34/95 |
| 5,619,806 | 4/1997 | Warren | 34/331 |
| 5,706,587 | 1/1998 | Lehtinen et al. | 34/71 |

FOREIGN PATENT DOCUMENTS

| | | |
|---|---|---|
| 61537 | 4/1982 | Finland . |
| 78755 | 5/1989 | Finland . |

*Primary Examiner*—Henry A. Bennett
*Assistant Examiner*—Steve Gravini
*Attorney, Agent, or Firm*—Ladas & Parry

[57] ABSTRACT

An apparatus for drying and smoothing a fibre web (5) between two tight bands (1, 2) that move in parallel and turn around turning rolls (6*a*, 6*b*, 7*a*, 7*b*), the first band (1) being heated with hot steam and the second band (2) being cooled with water, and the fibre web (5) being conducted through the drying zone that the bands (1, 2) define together with at least one felt or wire (3, 4) such that the fibre web (5) is in contact with the surface of the first, heated band (1) and that the felt or wire (3, 4) is between the fibre web (5) and the second, cooled band (2). In the invention, the fibre web (5) is smoothed such that the press means located in the vicinity of the first turning rolls (6*a*, 7*a*) in the travel direction of the fibre web (5) apply to it a pressure that is essentially higher than the pressure in the other parts of the drying zone. The pressure that the fibre web is subjected to in the drying zone is sufficiently high to prevent the fibre web from shrinking in the longitudinal and transverse directions, and yet sufficiently low to prevent the fibre web from becoming essentially thinner.

13 Claims, 2 Drawing Sheets

APPARATUS FOR DRYING AND SMOOTHING A FIBRE WEB

Figure 1:
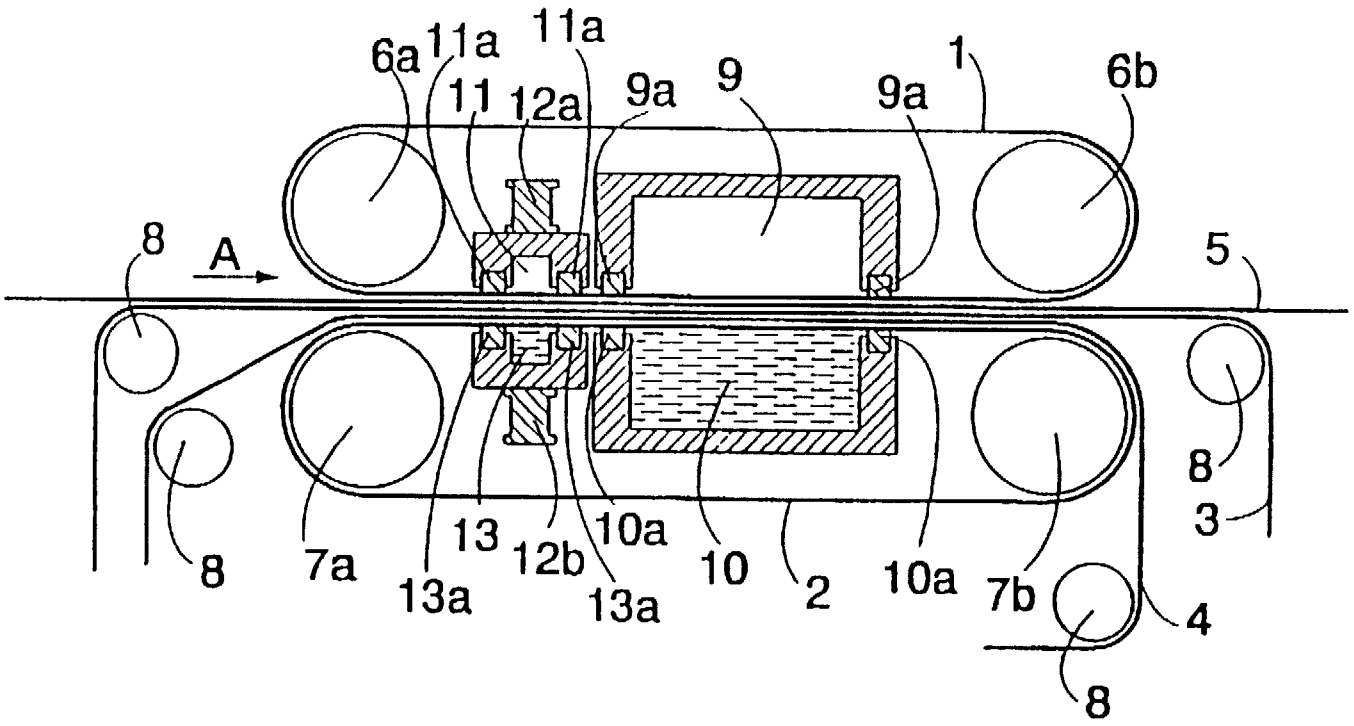

The invention relates to an apparatus for drying and smoothing a fibre web, the apparatus comprising two endless bands that are impermeable to air and have a good thermal conductivity; first turning rolls, the first band being arranged to turn around said first turning rolls; and second turning rolls, the second band being arranged to turn around said second turning rolls; the first and second bands being arranged to run part of the way in parallel such that they define a drying zone between them, the first band being heated and the second band being cooled, and a fibre web and at least one felt or wire running between the bands such that the fibre web is in contact with the first, heated band, and the felt or wire is between the fibre web and the second, cooled band.

Drying of a fibre web between two parallel metal bands moving in the same direction such that the fibre web is in contact with the heated metal band and that there is a felt between the fibre web and the second, cooled metal band, whereby the steam separated from the fibre web by heating condenses to the felt by the effect of the cold metal band, is previously known from many patent publications, such as Finnish Patents 61,537 and 78,755. The basic idea is that two endless metal bands are arranged to run around turning rolls and that against the surface defined by the loops that the bands form are provided pressure chambers containing hot steam and water, respectively, such that the pressure produced presses the hot and cold bands against the fibre web and felt located between them. The bands, which are located between the pressure chambers, together with seals provide one side for the pressure chambers such that the steam and water can directly affect the bands. The operation of the apparatus is fully known per se and has been disclosed e.g. in the above patent publications, which are incorporated herein by reference.

In the solution of Finnish Patent 61,537, the temperature of the web is quite high, typically over 120° C., and due to the pressurized steam and water, the mechanical z-pressure is also high, typically over 1 bar. Dried in this manner, webs that contain large quantities of lignin and hemicellulose are rended very strong, and a smooth surface is provided on the side of the web that faces the heated metal band. A drawback of the high compression force, however, is that the web density becomes very high in the direction of thickness, i.e. the web thickness collapses in a way, which often impairs the stiffness of the web. If this drawback were to be avoided in the solution of the publication, the temperature of the cooling water would have to be raised so close to the temperature of the heating steam that the drying rate would notably slow down and the apparatus would have to be made much longer.

Finnish Patent 61,537 also teaches that the cooling space of the apparatus can be divided into various separate spaces. This, however, is very complicated to implement, and it is equally complicated to arrange counter supports on the steam box side, which are needed because of different pressures prevailing in the cooling space.

Finnish Patent 78,755, in turn, teaches a solution in which there is essentially no external excess pressure outside the metal band, but the metal bands are subjected to approximately normal atmospheric pressure. The thermal energy needed for drying the web is obtained by pre-heating the metal band, whereby the thermal energy stored therein vaporizes the water present in the web, starting the drying process. The hot metal band enters the drying zone at a temperature of about 150° to 200° C., cooling correspondingly in the travel direction of the machine as heat transfers from the band to the web. The web is here subjected to a mechanical z-pressure of at most close to 100 kPa, while the temperature of the cooled metal band is maintained low, e.g. at about 20° C., by the use of e.g. a cold water jet or some other cooling method. If the difference of temperature between the metal bands remains higher than e.g. about 50° C., the drying rate achieved with this solution is often sufficient.

When a low z-pressure solution disclosed in the above patent is used, the thickness and bending stiffness of the board remain good, but the surface produced with the apparatus is not as smooth as the one produced with a high z-pressure apparatus.

The object of the present invention is to provide a drying apparatus with which the fibre web is rendered very smooth and glossy on one surface, without essentially lowering the thickness and bending stiffness of the web.

The drying apparatus of the invention is characterized in that the apparatus comprises at least one separate set of press means for pressing the fibre web.

An essential idea of the invention is that when the web is between the bands, it is subjected to a separate compression force at the front end of the zone defined by the bands. Another essential idea is that after the above-mentioned compression, the web is subjected to further compression such that the compression in the z direction of the web is not reduced before the drying, nor during the drying, so much that the web would essentially change its shape in the x and y directions due to internal forces of shrinkage. Further, the compression in the z direction of the web is not allowed to rise so high that the web would become essentially thinner. Yet another essential idea is that the temperature of the surface of the heated steel band that is in contact with the web is suitably high to give the surface of the web a desired gloss.

An essential advantage achieved with the invention is that the characteristics of the fibre web produced with the apparatus can be controlled by adjusting the parameters of the different elements of the apparatus. Another essential advantage is that the surface of the web that is in contact with the heated band can be rendered smooth by conducting the fibre web through the compression zone at the front end of the zone defined by the bands. Yet another essential advantage is that in the drying zone, the fibre web is subjected in the z direction to a pressure that is sufficiently high to essentially prevent the web from shrinking in the x and y directions, and yet sufficiently low to prevent the web from becoming essentially thinner. Still another essential advantage is that the gloss of the surface of the fibre web can be controlled by controlling the temperature of the band to be heated.

The invention is described in greater detail in the attached drawings, in which

Figure 2:
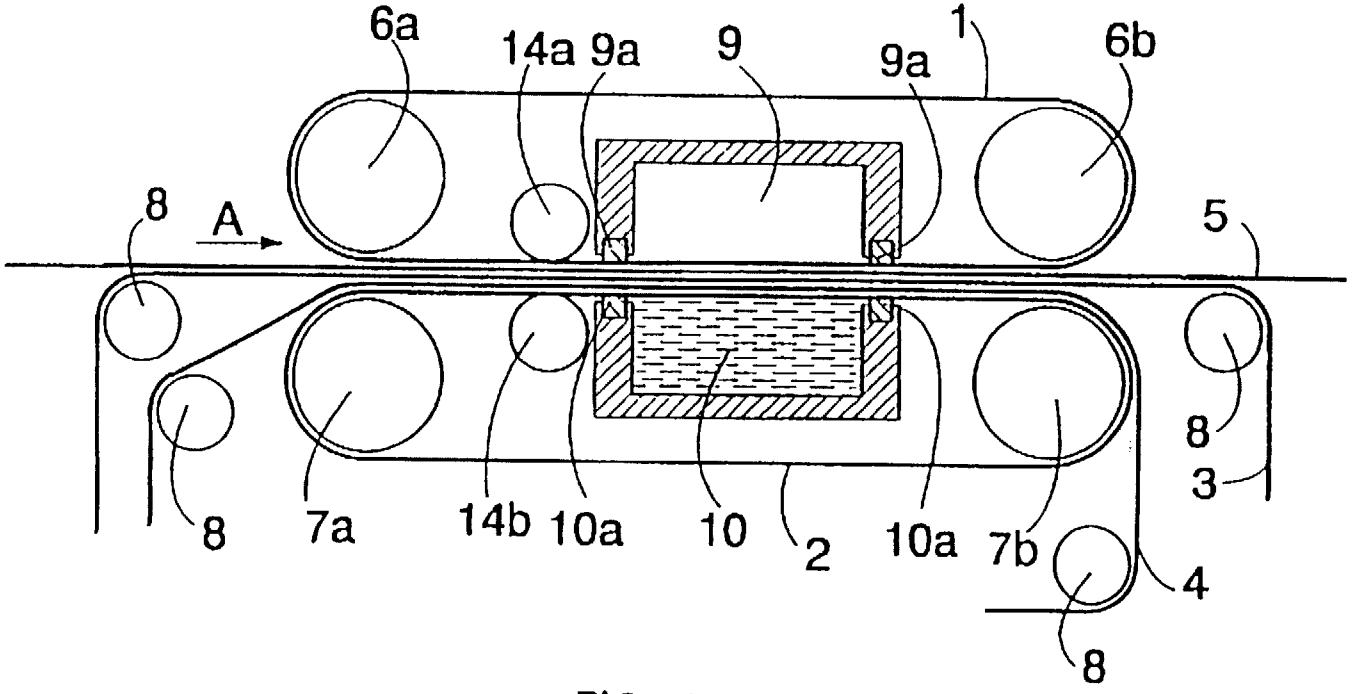

FIG. 1 is a schematic sectional side view taken in the travel direction of the web, illustrating one embodiment of a drying apparatus according to the invention, and FIG. 2 is a schematic sectional side view taken in the travel direction of the web, illustrating another embodiment of a drying apparatus according to the invention.

FIG. 1 is a schematic sectional side view taken in the travel direction of the web, illustrating a drying apparatus according to the invention. The drying apparatus comprises two endless bands that are impermeable to air, have a good thermal conductivity, and are preferably made of metal: a first band 1, or an upper band, and a second band 2, or a lower band; a fine wire or felt 3, a coarse wire 4 and a fibre web 5 passing between those surfaces of the bands that face each other. The fibre web 5 moves in the direction indicated by arrow A. The first band 1 is arranged to turn around first turning rolls 6*a* and 6*b* located at the ends of the drying apparatus. Correspondingly, the second band 2 is arranged to turn around second turning rolls 7*a* and 7*b* located below the first turning rolls 6*a* and 6*b* at the ends of the drying apparatus. The wires 3 and 4 are supported and guided by guide rolls 8. Since the pressure prevailing in the drying zone in the area between the bands 1 and 2 is usually different from the pressure prevailing outside or on the sides of the bands 1 and 2, seals are arranged on both sides of the apparatus between or at the edges of the bands 1 and 2, said seals preventing liquid or gas from moving out from the area between the bands 1 and 2 through the sides, or vice versa. To effect vapour heating required by the drying process, the drying apparatus comprises a pressure chamber 9, which is located above the first band 1. The first band 1 is sealed with seals 9*a* in respect of the pressure chamber 9 such that the steam in the pressure chamber 9 is maintained at a suitable pressure. Below the second band 2 there is a water chamber 10, which contains water that cools the second band 2. At the edges of the water chamber 10 there are seals 10*a*, with which the second band 2 is sealed in respect of the water chamber 10.

The operation of the drying apparatus is based on heating the first band 1, which comes into contact with the web 5, by hot steam contained in the pressure chamber 9, whereby the water in the web 5 is vaporized and transferred through the wires 3 and 4 toward the second band 2 because of the temperature of the first band 1. The second band 2, in turn, is continuously cooled with water located below it, whereby the steam produced on the surface thereof condenses into water and is removed with the wires 3 and 4.

Further, before the steam chamber 9 and the water chamber 10 in the travel direction of the fibre web 5 there is a compression zone. The compression zone is preferably arranged as close as possible to the first turning rolls 6*a* and 7*a* in the travel direction of the web. The compression zone is formed by a front steam chamber 11 and a front water chamber 13. The front steam chamber 11 is sealed in respect of the first band 1 with seals 11*a*. Correspondingly, the front water chamber 13 is sealed in respect of the second band with seals 13*a*. The front steam chamber 11 is supported with a supporting structure, such as a beam 12*a*, and the front water chamber 13 is supported by a similar supporting structure, such as a beam 12*b*.

The compression zone is short as compared with the drying zone. The compression zone is 0.1 to 3 m in length, typically 1 to 3 m. On average, the pressure is essentially the same in the front steam chamber 11 and the front water chamber 13, varying from 1 to 8 bars of excess pressure, typically from 1 to 4 bars of excess pressure.

The fibre web 5 is first led between the first band 1 and the second band 2 to the compression zone. In the compression zone, the fibre web 5 is subjected to such a high pressure that the surface of the fibre web 5 facing the first band 1 becomes smooth. The compression zone should be made so short that the fibre web 5 does not lose too much of its thickness, which would weaken its bending stiffness. After the compression zone, the fibre web 5 is conducted to the drying zone, where the fibre web 5 is pressed between the first, heated band 1 and the second, cooled band 2 so tightly that the fibre web 5 is not able to shrink in the longitudinal and transverse directions. The characteristics of the produced web 5 are thereby the same along the entire width of the machine, if the web 5 supplied to the apparatus is of equal quality along the entire width of the machine. On the other hand, the fibre web 5 must not be subjected to so high a pressure even in the drying zone that the fibre web 5 would become essentially thinner. In the embodiment of FIG. 1, the drying of the fibre web 5 starts at the compression zone. The fibre web 5 is preferably subjected in the compression zone to a higher pressure than elsewhere between the bands 1 and 2.

According to one preferred embodiment, the pressure in the steam chamber 9 and the water chamber 10, which form the drying zone, may be essentially the same as the atmospheric pressure. The pressure to which the fibre web 5 is subjected can be controlled by controlling the temperature of the cooling water in the water chamber 10 and thereby the temperature of the second, cooled band 2: the colder the surface of the cooled band 2, the greater the pressure that the fibre web 5 is subjected to. The steam chamber 9 and the water chamber 10 typically have an essentially equal excess pressure of 0.1 to 2 bars. By the control of the temperature of the steam chamber 9 and thereby the temperature of the surface of the first band 1, the surface of the fibre web 5 facing the first, heated band 1 can be given a desired gloss. The adjustment of the parameters of the compression and drying zones thus makes it possible to control the characteristics of the produced fibre web 5 in the desired manner.

FIG. 2 shows a sectional schematic side view of another embodiment of an apparatus according to the invention, taken in the travel direction of the web. The reference numbers in FIG. 2 correspond to those used in FIG. 1. In the apparatus of FIG. 2, the fibre web 5 is pressed before the drying zone with press rolls 14*a* and 14*b*. The press rolls 14*a* and 14*b* are arranged to rotate such that their axles are transverse to the travel direction of the machine. The first press roll 14*a* is arranged to press the first, heated band 1, and the second press roll 14*b* is arranged at the same place but on the other side of the fibre web 5 to press the second, cooled band 2. The band and wire package comprising a first band 1, a fibre web 5, a fine wire 3, a coarse wire 4 and a second, cooled band 2 thereby runs through a nip formed by the press rolls 14*a* and 14*b*.

The specification and the drawings attached thereto are only intended to illustrate the idea of the invention. The claimed drying and smoothing apparatus may vary in its details within the scope of the claims. It is thus not essential what pressure medium is used in the chambers that form the compression zone. In the front steam chamber 11, the pressure medium may be e.g. air instead of steam. Further, in the front water chamber 13, air can be used instead of water as the pressure medium. Further, the pressure medium in the steam chamber 9 may be e.g. steam, air or hot fuel combustion products, and the pressure medium in the water chamber 10 may be e.g. air, as well as water.

The first, heated band 1 can also be heated before it enters the drying zone, e.g. in a separate heating zone or by using the first turning rolls 6*a* and 6*b* as heating elements. Heating can also be implemented e.g. by blowing hot fuel combustion gases against the first band 1 by means of suitable nozzles and gas outlet channels. Correspondingly, the second, cooled band 2 can be cooled before the drying zone e.g. by air or water jet cooling or by feeding a suitable cooling medium, such as water, to the rolls of the second band, e.g. to the second turning rolls 7*a* and 7*b*. The heating and/or cooling of the bands 1 and 2 effected before the drying zone can be implemented such that the steam chamber 9 and/or the water chamber 10 can be left out altogether. The drying zone is thereby formed between the turning rolls 6a, 6b, 7a and 7b, whereby the press means are within the drying zone. In the situations illustrated by FIGS. 1 and 2, the press means can also be within the drying zone defined by the steam chamber 9 and the water chamber 10. If both chambers are left out, the pressure prevailing outside the bands 1 and 2 is atmospheric pressure.

The apparatus may comprise one or more sets of press means smoothing the fibre web 5.

The pressure that smooths the fibre web 5 can also be produced by pressing with the turning rolls 6a and 7a that are first in the travel direction of the fibre web 5, whereby the use of separate press rolls and compression chambers is avoided.

What is claimed is:

1. An apparatus for drying and smoothing a fibre web, the apparatus comprising two endless bands (1, 2) that are impermeable to air and have a good thermal conductivity; first turning rolls (6a, 6b), the first band (1) being arranged to turn around said first turning rolls (6a, 6b); and second turning rolls (7a, 7b), the second band (2) being arranged to turn around said second turning rolls (7a, 7b); the first (1) and second (2) bands being arranged to run part of the way in parallel such that they define a drying zone between them, the first band (1) being heated and the second band (2) being cooled, and a fibre web (5) and at least one felt or wire (3, 4) running between the bands (1, 2) such that the fibre web (5) is in contact with the first, heated band (1), and the felt or wire (3, 4) is between the fibre web (5) and the second, cooled band (2) and that the drying zone is formed by a steam chamber (9) and a water chamber (10), characterized in that the apparatus comprises at least one separate set of press means for pressing the fibre web (5).

2. An apparatus according to claim 1, characterized in that the means for pressing the fibre web (5) are chambers that contain pressurized medium.

3. An apparatus according to claim 2, characterized in that the temperatures of the media in the medium-containing chambers that function as press means are different such that the chamber that contains the hotter medium presses against the first, heated band (1), and the chamber that contains the cooler medium presses against the second, cooled band (2).

4. An apparatus according to claim 2, characterized in that the pressure in the chambers that function as means for pressing the fibre web (5) is essentially the same, being from 1 to 8 bars of excess pressure.

5. An apparatus according to claim 2, characterized in that the chambers that function as means for pressing the fibre web (5) provide a compression zone, which is from 0.1 to 3 m in length.

6. An apparatus according to claim 1, characterized in that the means for pressing the fibre web (5) are press rolls (14a, 14b), the press rolls (14a, 14b) being arranged to rotate and the axles of the press rolls (14a, 14b) being transverse to the travel direction of the fibre web (5), and that the first press roll (14a) is arranged to be in contact with the first, heated band (1), and the second press roll (14b) is arranged to be in contact with the second, cooled band (2), whereby the first, heated band (1), the fibre web (5), the fine wire (3), the coarse wire (4) and the second, cooled band (2) run through a nip formed by the press rolls (14a) and (14b).

7. An apparatus according to claim 1, characterized in that the first turning rolls (6a, 7a) of the first set of turning rolls (6a, 6b) and the second set of turning rolls (7a, 7b) in the travel direction of the fibre web (5) function as the means for pressing the fibre web (5).

8. A drying apparatus according to claim 1, characterized in that at least one set of press means for pressing the fibre web (5) are located in the drying zone.

9. A drying apparatus according to claim 1, characterized in that at least one set of press means for pressing the fibre web (5) are located before the drying zone.

10. An apparatus according to claim 1, characterized in that the first, heated band (1) and the second, cooled band (2) are arranged to press the fibre web (5) such that the fibre web (5) does not shrink essentially in the longitudinal and transverse directions.

11. An apparatus according to claim 1, characterized in that the first, heated band (1) and the second, cooled band (2) are arranged to press the fibre web (5) such that the thickness of the fibre web (5) remains essentially the same.

12. An apparatus according to claim 1, characterized in that the first, heated band (1) is arranged to heat the surface of the fibre web (5) to give the surface of the fibre web (5) a suitable gloss.

13. An apparatus according to claim 1, characterized in that the press means press the fibre web (5) with a pressure that is essentially higher than the pressure that the fibre web (5) is subjected to in the other parts of the drying zone.

* * * * *